US006848901B1

(12) United States Patent
Matsuyama

(10) Patent No.: US 6,848,901 B1
(45) Date of Patent: Feb. 1, 2005

(54) APPARATUS FOR CONTROLLING CHARACTERISTICS OF A FLAME

(76) Inventor: Susumu Matsuyama, 2005 Palmetto Dunes Ct., Duluth, GA (US) 30097

( * ) Notice: Subject to any disclaimer, the term of this patent is extended or adjusted under 35 U.S.C. 154(b) by 0 days.

(21) Appl. No.: 10/646,172

(22) Filed: Aug. 22, 2003

(51) Int. Cl.[7] ..... F23D 3/04
(52) U.S. Cl. ..... 431/310; 431/321; 431/322
(58) Field of Search ..... 431/310, 320, 431/321, 322; 222/187

(56) References Cited

U.S. PATENT DOCUMENTS

| | | | | |
|---|---|---|---|---|
| 9,843 A | | 7/1853 | Phineas | |
| 213,052 A | | 3/1879 | Lubin | |
| 241,298 A | | 5/1881 | Carnahan | |
| 403,151 A | | 5/1889 | Siemang et al. | |
| 467,736 A | | 1/1892 | Fernelmont et al. | |
| 585,822 A | | 7/1897 | Larwill et al. | |
| 959,804 A | * | 5/1910 | Purdy | 431/321 |
| 1,037,948 A | * | 9/1912 | Mangin | 431/321 |
| 3,516,774 A | | 6/1970 | Livingstone | |
| 4,269,591 A | * | 5/1981 | Knoll | 431/312 |

* cited by examiner

*Primary Examiner*—Alfred Basichas
(74) *Attorney, Agent, or Firm*—Thomas, Kayden, Horstmeyer & Risley LLP

(57) ABSTRACT

The present invention provides methods and apparatus for controlling a flame. One embodiment comprises a reservoir for a flame-fueling liquid, a wick, and a collar surrounding the wick. The first end of the wick is within the reservoir and a flame-bearing end is above the first end. Flame-fueling liquid is supplied to the reservoir and is communicated up the wick to fuel a flame emanating from the flame-bearing end of the wick. The collar is slidable along a vertical axis between a first and second position. In the first position, the top of the collar is located above the flame-bearing end of the wick to block the flow of air from reaching the wick. In the second position, the top of the collar is located blow the flame-bearing end of the wick, such that it does not substantially block the flow of air from reaching the wick.

19 Claims, 5 Drawing Sheets

APPARATUS FOR CONTROLLING CHARACTERISTICS OF A FLAME

FIELD OF THE INVENTION

The present invention relates to an apparatus for controlling characteristics of a flame.

BACKGROUND

Some fuels burned by oil lamps produce relatively large amounts of smoke, but are still in use because they have other beneficial properties. For example, citronella oil produces smoke but is useful for repelling insects, such as mosquitoes.

Air drafts around the flame tend to increase the amount of smoke produced, so some existing lamps provide a shield around the flame to protect from air drafts. However, shielding the flame from air drafts can result in an inadequate air supply to the flame. This inadequate air supply results in incomplete combustion, which has several side effects. One side effect is an increase in the amount of smoke produced. Another side effect is a flame that is non-uniform in color and luminosity, with a bright area at the top of the flame and a dark area in the bottom center.

A well-known technique to control the height of a flame involves increasing or decreasing the amount of wick exposed to the fuel. For example, an adjusting knob or screws can be used to raise or lower the wick. However, the adjusting knob increases the cost of the lamp, and is often hard to clean. A need therefore exists to address these and other shortcomings in the prior art.

SUMMARY

The present invention is directed to unique methods and apparatus for controlling a flame. One embodiment comprises a reservoir for containing a flame-fueling liquid, a wick, an air channel disposed to supply oxygen to the wick, and a collar surrounding the wick. The first end of the wick is disposed within the reservoir and a second, flame-bearing end is substantially located above the first end. When the flame-fueling liquid is supplied to the reservoir, the flame-fueling liquid is communicated up the wick to fuel a flame emanating from the flame-bearing end of the wick. A first end of the air channel is substantially located near the flame-bearing end of the wick. The collar is slidable along a vertical axis between a first position and a second position. In the first position, a top portion of the collar is located above the flame-bearing end of the wick to substantially block the flow of atmospheric air from reaching the wick. In the second position, the top portion of the collar is located below the flame-bearing end of the wick, such that the collar does not substantially block the flow of atmospheric air from reaching the wick.

DETAILED DESCRIPTION

Figure 1:
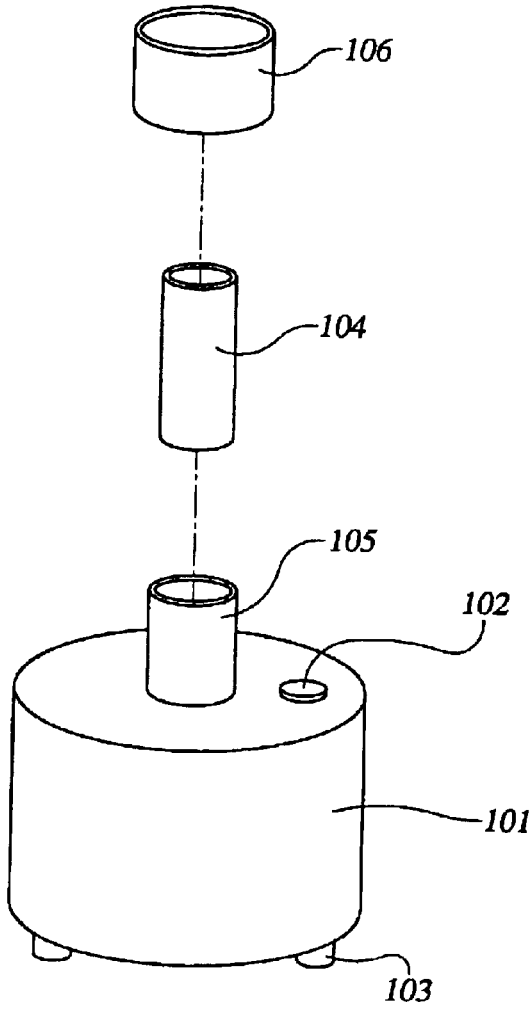
FIG. 1 is an exploded perspective view of one embodiment of an apparatus for controlling the height of a flame.

FIG. 1 is an exploded perspective view of one embodiment of an apparatus for controlling the height of a flame. The apparatus includes: a fuel reservoir 101; a cap 102; projections 103; a wick 104; a sleeve 105; and a collar 106.

The fuel reservoir 101 contains liquid fuel, for example, liquid paraffin, mineral oil, citronella oil, alcohol, or a variety of other suitable fuels. Cap 102 allows the fuel reservoir 101 to be filled, and also regulates the flow of air into fuel reservoir 10 1. Projections 103 extend along the bottom surface of fuel reservoir 101.

Wick 104 communicates the liquid fuel from fuel reservoir 101 to a flame-bearing end (see FIGS. 3A and 3B) of the wick, where a flame bums. The wick 104 may be made of any suitable material, such as glass fiber or metal mesh, as long as the wick draws liquid fuel from the fuel reservoir. In the embodiment shown in FIG. 1, wick 104 is a hollow cylinder. In another embodiment, wick 104 is a solid cylinder.

Wick 104 fits into sleeve 105. In one embodiment, the sleeve 105 is shaped to closely conform to wick 104. Sleeve 105 prevents expansion of the flame to the lower part of wick 104. In one embodiment, sleeve 105 is made of a heat-conductive material, for example, copper or glass, to lower the viscosity of the liquid fuel.

Collar 106 is dimensioned to surround a top portion of wick 104. Collar 106 can be made of any suitable material, for example metal or glass. Collar 106 is slidably adjustable along the vertical axis of the wick, using an adjustment mechanism (shown in FIG. 2). Movement of collar 106 along this axis from bottom to top covers an increasing portion of wick 104.

Figure 2:
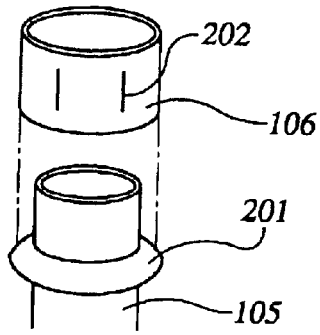
FIG. 2 illustrates one embodiment of an adjustment mechanism that can be used with the apparatus for controlling the height of a flame.

FIG. 2 illustrates one embodiment of an adjustment mechanism that can be used with the apparatus for controlling the height of a flame. In this embodiment, the adjustment mechanism takes the form of a flexible support 201 that fits around sleeve 105. Flexible support 201, for example, but not limited to, a rubber ring, is positioned underneath collar 106 to support collar 106. Because of the dimensions and characteristics of flexible support 201, it grips sleeve 105 tightly enough to hold collar 106 in the desired position above flexible support 201, yet loosely enough to allow flexible support 201 to be vertically adjusted to another position.

In another embodiment (not shown), the adjustment mechanism comprises one or more vertical slots in collar 106, through which screws protrude to secure collar 106 to sleeve 105. Upon loosening the screws, the vertical position of collar 106 can be adjusted, and then the screws are fastened again to secure the collar 106.

In one embodiment, collar 106 has at least one perforation 202 which allows a limited amount of air to pass through the collar 106 and provide air to the wick 104. It will be understood that perforations of any shape can be used, for example vertical slits, circular holes, etc.

Figure 3A:
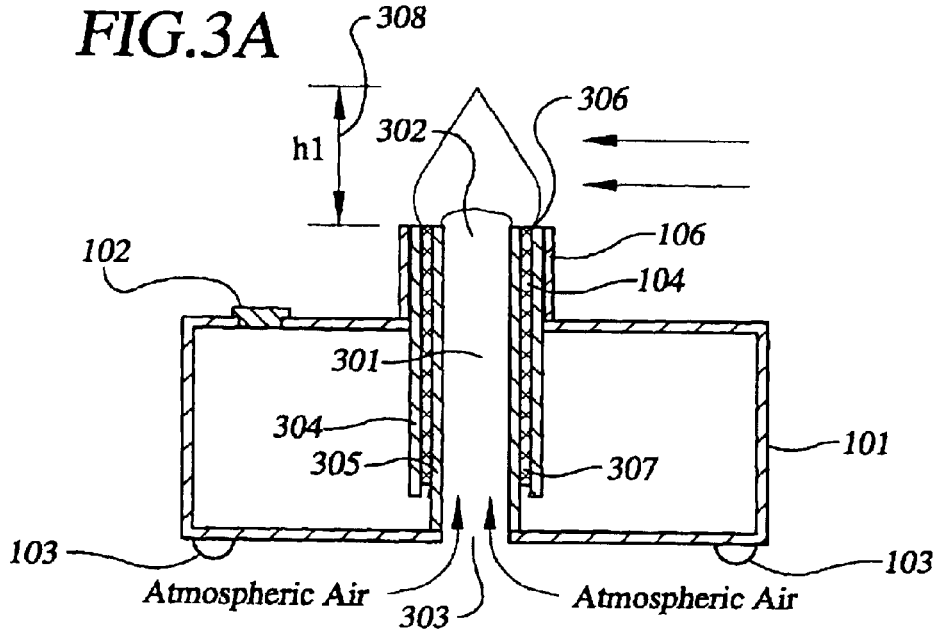
FIGS. 3A and 3B are cross-sectional side views of another embodiment of the apparatus for controlling the height of a flame, illustrating the flow of air and fuel.
Figure 3B:
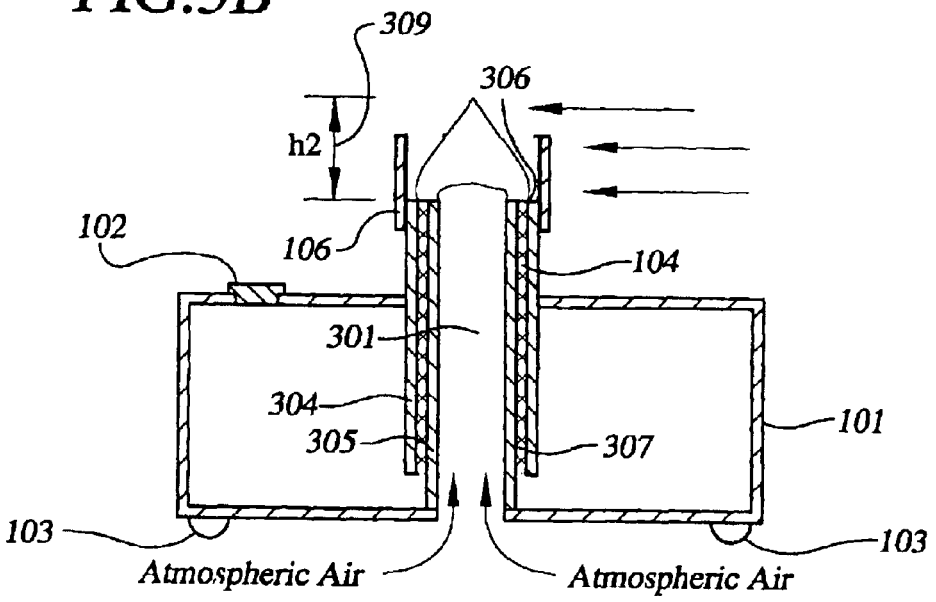

FIGS. 3A and 3B are cross-sectional side views of another embodiment of the apparatus for controlling the height of a flame, illustrating the flow of air and fuel. Air channel 301 has a first end 302 and a second end 303. When the apparatus rests on a surface, projections 103 create a space underneath the apparatus and allow atmospheric air to enter second end 303 and flow to the first end 302, which is located near the inner portion of wick 104 when wick 104 is fitted into sleeve 105. In this embodiment, air channel 301 runs through the center of fuel reservoir 101, such that first end 302 is located near the center of wick 104 and second end 303 is on the bottom surface of fuel reservoir 101.

Sleeve 105 comprises two walls 304, 305 which surround and support wick 104. Wick 104 has a flame-bearing end 306 and a fuel-supplying end 307. The walls 304, 305 provide increased capillary pressure on wick 104, allowing fuel to be efficiently transported through wick 104, from its fuel-supplying end 307 to its flame-bearing end 306. Wick 104 does not extend past sleeve 105, so that the wick is supplied only by the fuel inside sleeve 105.

The fuel flows generally as follows: surface tension of the liquid fuel draws fuel up through the fibers of the wick 104 by capillary action. When the wick 104 burns fuel at its flame bearing end 306, an equal amount is drawn up the wick 104 from fuel reservoir 101 to replenish the burned fuel. In normal operation, cap 102 is either absent or not tightly closed. Air flows from the atmosphere into fuel reservoir 101 to fill the void left by the burned fuel, so that the pressure outside the sleeve 105 and inside the sleeve 105 is the same. As long as the fuel level inside fuel reservoir is at or above the fuel-supplying end 307 of the wick 104, fuel is available to be drawn the wick 104.

In another mode of operation, cap is tightly closed so that air is unable to flow into fuel reservoir 101 to fill the void left by the burned fuel. In this mode, pressure outside the sleeve is not the same as pressure inside the sleeve 105, since air channel 301 supplies air inside the sleeve 105 but cap prevents air from flowing into the portion of the fuel reservoir 101 outside the sleeve 105. Because of this difference in pressure, fuel will no longer flow from the portion outside the sleeve 105 to the portion inside the sleeve 105 containing the fuel-supplying end 307 of the wick 104. When the fuel already present at the fuel-supplying end 307 of the wick 104 is consumed, the wick 104 will no longer be in contact with the fuel inside the sleeve 105. Since fuel is no longer available to the wick 104, the flame will diminish in size as the fuel in the wick 104 bums, and then the flame will finally be extinguished.

The supply of air to the outer portion of wick 104 is influenced by the position of collar 106. When collar 106 is at a lowered position, as shown in FIG. 3A, atmospheric air flows freely to the outer portion of wick 104. Air is also supplied to the inner portion of wick 104 by air channel 301. This maximal air supply to both inner and outer portions of wick 104 results in a flame with a height 308. In addition to its large size, the flame produced when the collar 106 is at the lowered position has other desirable characteristics. The flame has uniform color, a sharply defined shape, and slightly reduced luminosity, which makes it less harsh to the eyes. The maximal air supply leads to more complete combustion, which produces very little smoke.

In contrast, FIG. 3B shows the operation of the apparatus with collar 106 at a raised position. Here, the flow of atmospheric air to the outer portion of wick 104 is at least partially blocked by collar 106, while the inner portion of wick 104 receives a supply of air through air channel 301. This reduced air supply results in a flame with a height 309 which is less than height 308, but has the same shape, color and luminosity characteristics as described with regard to FIG. 3A. In one embodiment, slit 202 (shown in FIG. 2) allows some amount of atmospheric air to flow through collar 106 to wick 104 even when collar 106 is in the raised position.

Figure 4:
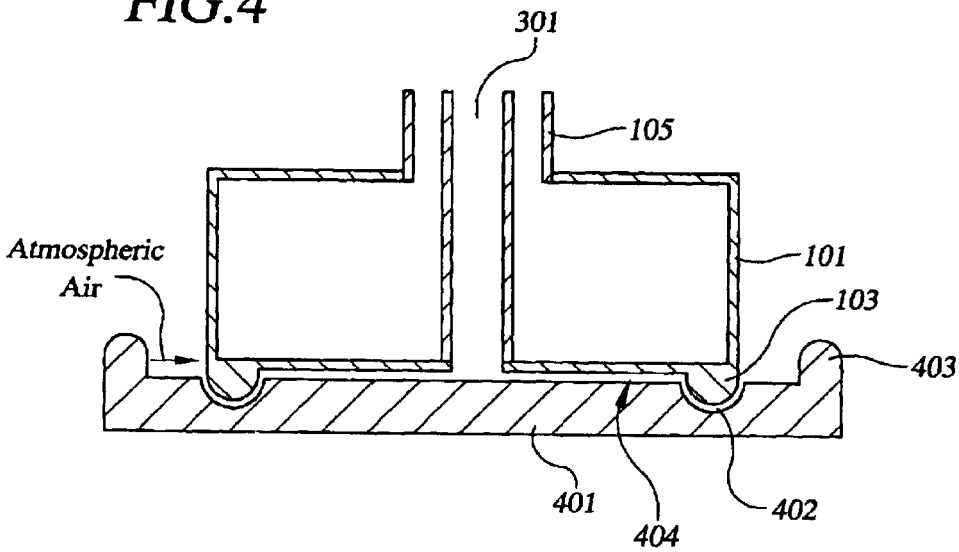
FIG. 4 is a cross-sectional side view of another embodiment of an apparatus for controlling the height of a flame.

FIG. 4 is a cross-sectional side view of another embodiment of an apparatus for controlling the height of a flame. In this embodiment, fuel reservoir 101 sits atop plate 401, and air flow to the inner portion of the wick (not shown) is controlled by changing the position of fuel reservoir 101 with respect to plate 401. This embodiment allows the flame height to be controlled without touching the collar 106, which may be too hot to touch after the flame has burned for some time.

Two or more projections 103 extend downward from the bottom surface of fuel reservoir 101. Plate 401 has two or more grooves 402 on its top surface, each of which is configured to receive one of the projections 103 on the bottom surface of fuel reservoir 101. In one embodiment, plate 401 also has a lip 403 extending upward from the top surface of fuel reservoir 101, along its periphery. Lip 403 keeps any fuel that spills from reservoir 101 from dripping off the plate 401, and reduces any air turbulence entering air channel 301.

To reduce air flow to the inner portion of the wick 104, reservoir 101 is positioned atop plate 401 such that projections 103 are received by grooves 402. The space between fuel reservoir 101 and plate 401 defines a horizontal air channel 404 which is contiguous with air channel 301. In this configuration, the height of horizontal channel 404 is relatively small, so that airflow into air channel 301 is reduced and the flame is non-uniform in color and luminosity. In one embodiment, plate 401 is covered with rubber or a similar material to increase suction between the two surfaces and thus further reduce the flow of air into air channel 301.

Figure 5:
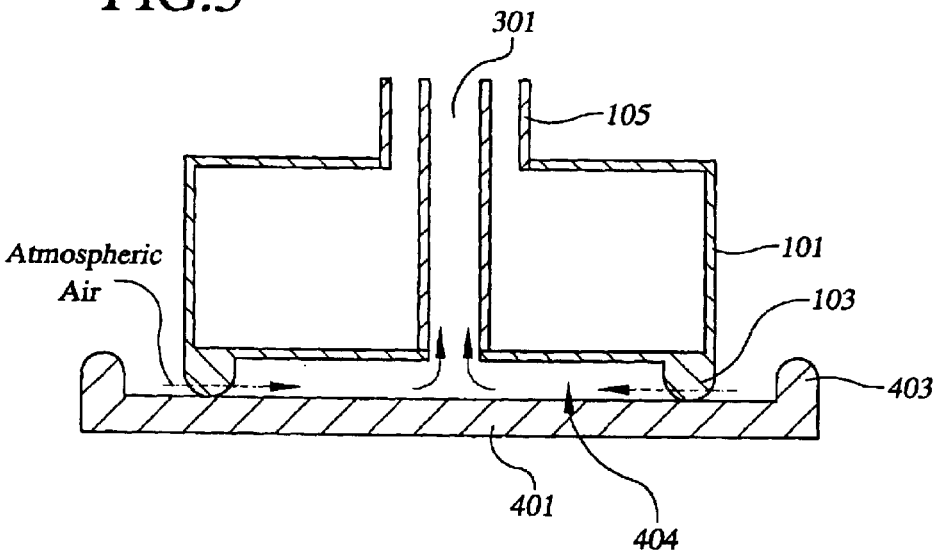
FIG. 5 is a cross-sectional view of the embodiment of FIG. 4, illustrating how the flow of air to the inside portion of the wick 104 is increased.

FIG. 5 is a cross-sectional view of the embodiment of FIG. 4, illustrating how the flow of air to the inside portion of the wick 104 is increased. Reservoir 101 is positioned atop plate 401 such that projections 103 are not received by grooves 402. In this configuration, the height of horizontal channel 404 is relatively large so that more airflow into air channel 301 is achieved. As a result, the flame is uniform in color and luminosity.

Figure 6A:
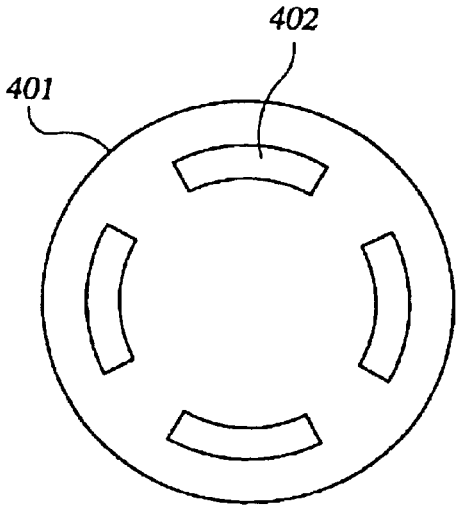
FIG. 6A is a top view of plate 401.

FIG. 6A is a top view of plate 401, showing grooves 402.

Figure 6B:
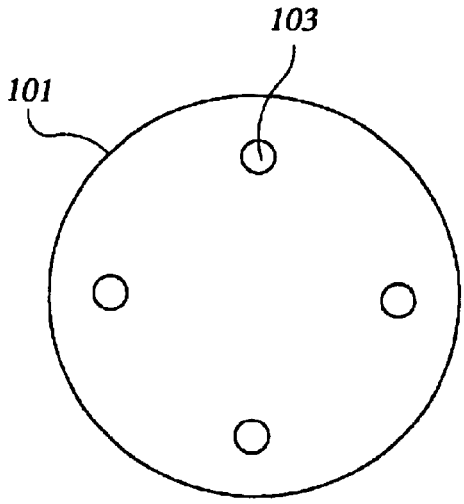
FIG. 6B is a bottom view of reservoir 101.

FIG. 6B is a bottom view of reservoir 101, showing projections 103.

The example embodiment of FIGS. 6A & 6B shows four equidistant grooves 402 and four equidistant projections 103. However, both the number of projections 103 and their placement can be varied, so long as stability is achieved. In addition, the number of grooves 402 may exceed the number of projections 103.

Figure 6C:
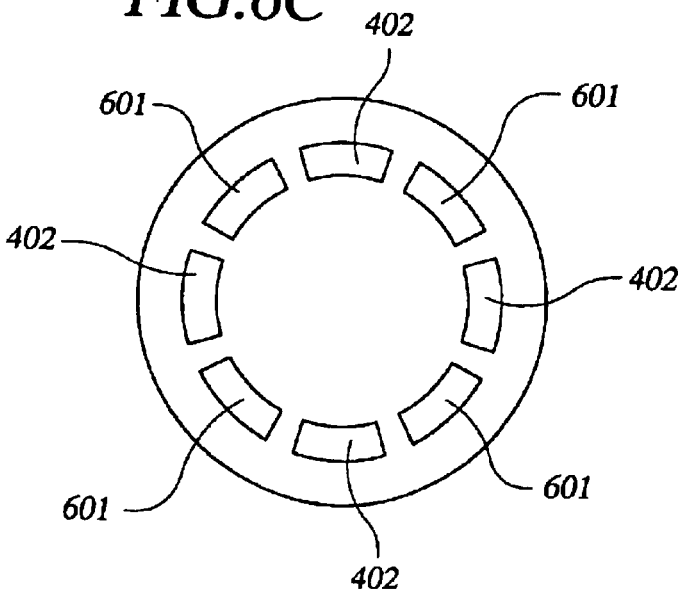
FIG. 6C is a top view of another embodiment of plate 401.

FIG. 6C is a top view of another embodiment of plate 401. In this embodiment, plate 401 has second grooves 601 which are adapted to partially receive projections 103. The depth of each second groove is such that when projections 103 are partially received by the second grooves, the height of horizontal channel 404 is relatively small, allowing a small amount of air to flow into air channel 301.

In yet another embodiment (not shown), the depth of groove 402 varies from a first depth, to an intermediate depth, to a second depth. The first depth is such that when projections 103 are received by the grooves 402 at the first depth, the height of horizontal channel 404 is relatively large, allowing a large amount of air to flow into air channel 301. This produces a tall flame, with a uniform color and slightly reduced luminosity, which is less harsh on the eyes.

The intermediate depth is such that when projections 103 are received by grooves 402 at the intermediate depth, the height of horizontal channel 404 is intermediate, allowing an intermediate amount of air to flow into air channel 301. The flame produced is shorter, but still has the uniform color and slightly reduced luminosity characteristics.

The second depth is such that when projections 103 are received by grooves 402 at the second depth, the height of horizontal channel 404 is relatively small, allowing only a small amount of air to flow into air channel 301. With the inner air supply greatly reduced, the inner portion of the flame does not burn completely, resulting in a small flame with non-uniform color and luminosity.

Figure 7:
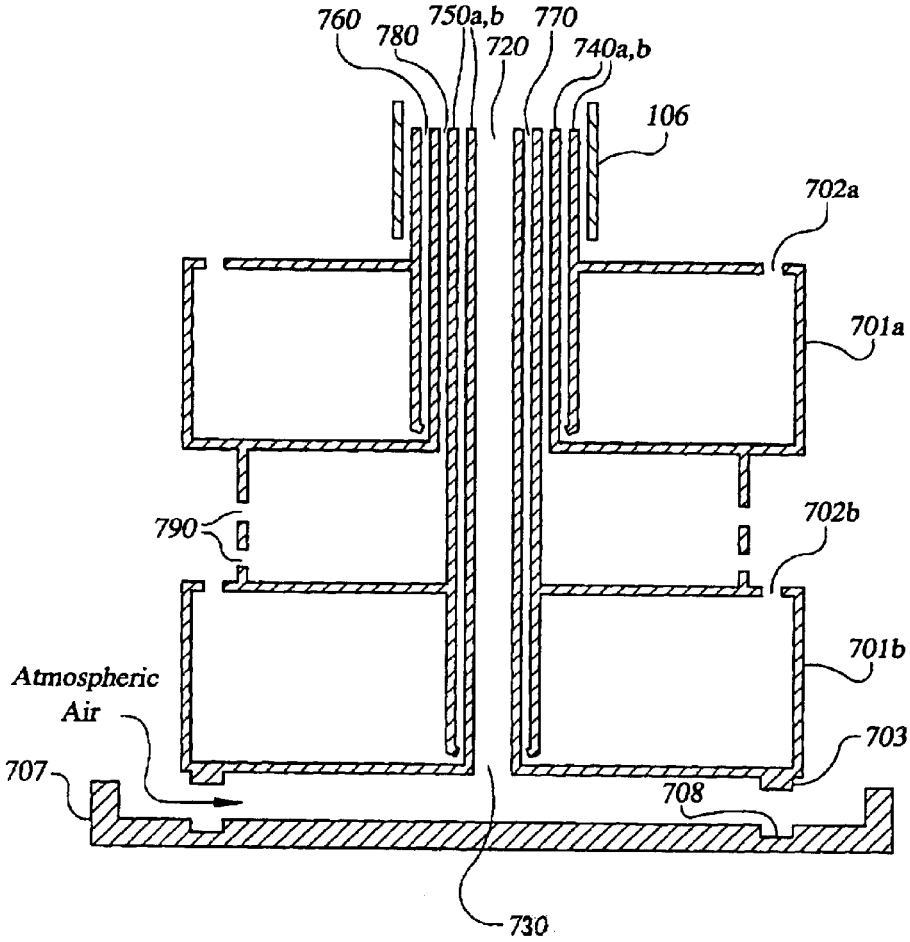
FIG. 7 is a cross-sectional side view of another embodiment of an apparatus for controlling a flame.

FIG. 7 is a cross-sectional side view of another embodiment of an apparatus for controlling a flame. The apparatus includes: fuel reservoirs 701*a* and 701*b*; caps 702*a* and 702*b*; projections 703; plate 707; groove 708; wicks 760 and 770.

The fuel reservoirs 701*a* and 701*b* contain liquid fuel, for example, liquid paraffin, mineral oil, citronella oil, alcohol, or a variety of other suitable fuels. In one embodiment, the fuels contained in fuel reservoirs 701*a* and 701*b* are different, so that the color characteristics of the flames may be different. Projections 703 extend from one surface of fuel reservoir 701*b*.

A fuel-bearing end of each wick 760, 770 is in communication with fuel reservoirs 701*a* and 701*b*. Each wick 760, 770 thus communicates the liquid fuel from fuel reservoir 701*a*, 701*b* to a flame-bearing end of the wick, where a flame burns. The wicks 770 and 760 may be made of any suitable material, such as glass fiber or metal mesh, as long as the wick draws liquid fuel from the fuel reservoir. In this exemplary embodiment, wicks 770 and 760 are concentrically disposed, and the flame-bearing end of each is disposed near one surface of fuel reservoir 701*a*.

Wick 760 fits into sleeve 740*a* and 740*b*. Wick 770 fits into sleeve 750*a* and 750*b*. The sleeves are shaped to closely conform to the wicks 770 and 760. Each sleeve 750, 740 prevents expansion of the flame to the lower part of the corresponding wick 770, 760. In one embodiment, sleeve 750, 740 is made of a heat-conductive material, for example, copper or glass, to lower the viscosity of the liquid fuel. Collar 106 was described above with reference to FIGS. 1 and 2.

Atmospheric air is supplied to the inner portion of wick 770 through a first air channel with a first end 720 located near the hollow center of wick 770. The second end 730 of the first air channel is located on one surface of reservoir 701*b*. Plate 707 and groove 708 were described with reference to FIGS. 4, 5, 6A–C. When the projections 703 are not received by groove 708, a horizontal channel is defined between one surface of fuel reservoir 701*b* and the plate 707. This horizontal channel allows atmospheric air to enter the second end 730 of air channel and flow to the first end 720, thus supplying air to the inner portion of wick 770.

Atmospheric air is supplied to the inner portion of wick 760 through a second air channel, with a first end 780 located between the two flame-bearing ends of the wicks 770 and 760 and a second end located between fuel reservoir 701*a* and fuel reservoir 701*b*. Opening 790 can be closed to prevent air from flowing through the second air channel.

Caps 702*a* and 702*b* allow the fuel reservoirs 701*a*, 701*b* to be filled, and also regulate the flow of air into fuel reservoir, 701*a*, 701*b* in the manner described with reference to FIG. 3A.

Each of the wicks 770, 760 produces a distinct and separate flame at its flame-bearing end. Flames with different characteristics can be produced by using different fuels in fuel reservoirs 701*a* and 701*b*. One characteristic that varies with the type of fuel is the flame color: liquid paraffin produces a yellow flame; citronella oil produces pink; oil blended with copper salts produces green or blue; oil blended with lithium salts produces red.

The foregoing description has been presented for purposes of illustration and description. It is not intended to be exhaustive or to limit the invention to the precise forms disclosed. Obvious modifications or variations are possible in light of the above teachings. The embodiments discussed, however, were chosen and described to illustrate the principles of the invention and its practical application to thereby enable one of ordinary skill in the art to utilize the invention in various embodiments and with various modification as are suited to the particular use contemplated. All such modifications and variation are within the scope of the invention as determined by the appended claims when interpreted in accordance with the breadth to which they are fairly and legally entitled.

What is claimed is:

1. An apparatus for controlling the height of a flame comprising:

a reservoir for containing a flame-fueling liquid;

a wick having a first end disposed within the reservoir and a second, flame-bearing end substantially located above the first end, whereby, when the flame-fueling liquid is supplied to the reservoir, the flame-fueling liquid is communicated up the wick to fuel a flame emanating from the flame-bearing end of the wick;

a collar surrounding the wick, the collar having a top portion, a bottom portion and a central portion, the central portion having one or more perforations, the collar slidable along a vertical axis between a first position and a second position, wherein in the first position a top portion of the collar is located above the flame-bearing end of the wick, wherein in the second position the top portion of the collar is located below the flame-bearing end of the wick, so that in the first position the collar substantially blocks the flow of atmospheric air from reaching the flame-bearing end of the wick while allowing atmospheric air to reach the flame-bearing end of the wick through the perforations, and in the second position the collar does not substantially block the flow of atmospheric air from reaching the wick.

2. The apparatus of claim 1, further comprising an adjusting means for adjusting the collar along the vertical axis.

3. The apparatus of claim 1, wherein the wick is shaped in the form of a hollow cylinder.

4. The apparatus of claim 1, wherein the wick has a solid cylindrical shape.

5. The apparatus of claim 1, wherein the wick is made of glass fiber.

6. The apparatus of claim 1, further comprising a wick sleeve to carry the first wick.

7. An apparatus for controlling the height of a flame comprising:

a reservoir for containing a flame-fueling liquid;

a wick having a first end disposed within the reservoir and a second, flame-bearing end substantially located above the first end, whereby, when the flame-fueling liquid is supplied to the reservoir, the flame-fueling liquid is communicated up the wick to fuel a flame emanating from the flame-bearing end of the wick;

a collar surrounding the wick slidable along a vertical axis between a first position and a second position, wherein in the first position a top portion of the collar is located above the flame-bearing end of the wick, wherein in the second position the top portion of the collar is located below the flame-bearing end of the wick, so that in the first position the collar substantially blocks the flow of atmospheric air from reaching the wick, and in the second position the collar does not substantially block the flow of atmospheric air from reaching the wick;

a cap which controls the flow of atmospheric air into the reservoir; and a sleeve closely conforming to the shape of the wick and enclosing a substantial portion of the wick, wherein the fuel-supplying end of the wick does not extend past the sleeve.

8. An apparatus for controlling the height of a flame, comprising:

a reservoir for containing a flame-fueling liquid;

a wick having a first end disposed within the reservoir and a second, flame-bearing end substantially located above the first end, whereby, when the flame-fueling liquid is supplied to the reservoir, the flame-fueling liquid is communicated up the wick to fuel a flame emanating from the flame-bearing end of the wick;

a collar surrounding the wick slidable alone a vertical axis between a first position and a second position, wherein in the first position a top portion of the collar is located above the flame-bearing end of the wick, wherein in the second position the top portion of the collar is located below the flame-bearing end of the wick, so that in the first position the collar substantially blocks the flow of atmospheric air from reaching the wick, and in the second position the collar does not substantially block the flow of atmospheric air from reaching the wick; and an air channel disposed to supply oxygen to the wick, where a first end of the air channel is substantially located near the flame-bearing end of the wick.

9. The apparatus of claim 8, wherein the air channel is substantially disposed through a central portion of the fuel reservoir.

10. The apparatus of claim 8, wherein the second end of the air channel is substantially disposed beneath the first end of the wick.

11. The apparatus of claim 8, wherein the first end of the air channel is substantially disposed within a central portion of the wick.

12. An apparatus for controlling the height of a flame comprising:

a reservoir having a first surface, and a second surface opposite the first surface, the second surface having a plurality of projections;

a wick having a first end disposed within the reservoir and a second, a flame-bearing end substantially located above the first end, whereby, when a flame-fueling liquid is supplied to the reservoir, the flame-fueling liquid is communicated up the wick to fuel a flame emanating from the flame-bearing end of the wick;

a substantially vertical channel disposed within a central portion of the reservoir to supply oxygen to the wick, wherein a first end of the vertical channel is substantially disposed within a central portion of the flame-bearing end of the wick, wherein a second end of the vertical channel is located at the second surface of the reservoir;

a plate having a first and second groove for receiving each of the projections, the first groove having a first depth and the second groove having a second depth;

and a horizontal channel defined between the plate and the second surface and contiguous with the vertical channel, wherein when the projections are received by the first groove the horizontal channel has a first height, and when the projections are received by the second groove the horizontal channel has a second height which is smaller than the first height.

13. The apparatus of claim 12, further comprising a third groove having a third depth, where the third depth is between the first depth and the second depth.

14. The apparatus of claim 12, wherein the first and second grooves are contiguous to form a single groove having a depth varying between the first depth and the second depth.

15. The apparatus of claim 12, wherein the base and the plate are cylindrical and the first and second grooves are arcuate.

16. The apparatus of claim 12, wherein the wick is made of glass fiber.

17. The apparatus of claim 12, further comprising a wick sleeve to carry the first wick.

18. An apparatus for controlling the height of a flame comprising:

a first reservoir for containing a first flame-fueling liquid;

a second reservoir for containing a second flame-fueling liquid, having a plurality of projections extending from a first surface;

a first wick shaped in the form of a hollow cylinder, having a first end disposed within the first reservoir and a second, flame-bearing end located above the first end, whereby, when the first flame-fueling liquid is supplied to the first reservoir, the first flame-fueling liquid is communicated up the first wick to fuel a first flame emanating from the flame-bearing end of the first wick;

a second wick shaped in the form of a hollow cylinder, having a first end disposed within the second reservoir and a second, flame-bearing end located above the first end, wherein the first wick is centrally disposed and the second wick is coaxially aligned with the first wick, whereby, when the second flame-fueling liquid is supplied to the second reservoir, the second flame-fueling liquid is communicated up the second wick to fuel a second flame emanating from the flame-bearing end of the second wick;

a first air channel disposed within a central portion of the first wick, where a first end of the first air channel is located near the flame-bearing end of the first wick, where a second end of the first air channel is located near the first surface of the second reservoir;

a second air channel located between the first wick and the second wick;

a plate having a first and second groove for receiving each of the projections, the first groove having a first depth and the second groove having a second depth;

and a horizontal channel defined between the plate and the first surface of the second reservoir and contiguous with the second end of the first air channel, wherein when the projections are received by the first groove the horizontal channel has a first height, and when the projections are received by the second groove the horizontal channel has a second height which is smaller than the first height.

19. The apparatus of claim 18, further comprising a collar surrounding the second wick slidable along a vertical axis between a first position and a second position, wherein in the first position a top portion of the collar is located above the flame-bearing end of the second wick, wherein in the second position the top portion of the collar is located below the flame-bearing end of the second wick, so that in the first position the collar substantially blocks the flow of atmospheric air from reaching the second wick, and in the second position the collar does not substantially block the flow of atmospheric air from reaching the second wick.

* * * * *